United States Patent [19]

Fisher et al.

[11] Patent Number: 4,795,997

[45] Date of Patent: Jan. 3, 1989

[54] THERMOSTAT FOR BOARD MOUNTING

[75] Inventors: David F. Fisher, Martinsburg, W. Va.; David A. Sprankle, Hagerstown, Md.

[73] Assignee: North American Philips Corporation, New York, N.Y.

[21] Appl. No.: 116,602

[22] Filed: Nov. 2, 1987

[51] Int. Cl.[4] ..... H01H 37/04

[52] U.S. Cl. ..... 337/380; 310/68 C; 337/372; 361/388

[58] Field of Search ..... 337/380, 372, 343, 365; 310/68 C; 361/386, 388

[56] References Cited

U.S. PATENT DOCUMENTS

| | | | |
|---|---|---|---|
| 4,045,761 | 8/1977 | Peterson | 337/372 |
| 4,308,517 | 12/1981 | Peterson | 337/372 |
| 4,620,175 | 10/1986 | Karr et al. | 337/343 |

*Primary Examiner*—H. Broome

*Attorney, Agent, or Firm*—F. Brice Faller

[57] ABSTRACT

Snap action thermostat has a housing molded onto two flat terminals to form a cavity wherein inner portions of the terminals are exposed. A contact arm is welded to the inner portion of one terminal, a dished bistable bimetal element is placed loosely in the cavity, and a fulcrum plate is provided thereover to bias the bimetal element against the contact arm in one of the stable positions to close the circuit. A mounting plate fixed to the housing provides a heat sink to ensure prompt temperature response.

6 Claims, 1 Drawing Sheet

THERMOSTAT FOR BOARD MOUNTING

BACKGROUND OF THE INVENTION

The present invention relates to a simple thermostat in a package having two terminals for mounting to a printed circuit board.

A DIP (dual in-line package) is an electronic component available in several standard sizes and includes a housing having downward extending terminal pins which are received in plated through holes of a PCB. The chip or the like in the housing is thus connected to circuitry and other components.

U.S. Pat. No. 4,620,175, which is incorporated herein by reference, discloses a simple thermostat configured as a standard DIP having four terminal pins. Since the package is virtually identical to a standard DIP, it does not require any special hole spacing by the PCB manufacturers or any special assembly equimment. The terminal pins come in two pairs, the pins in each pair being connected through a single inward end inside the housing so as to be electrically redundant.

The housing includes a floor, opposed parallel sidewalls, and opposed parallel endwalls which define a cavity therebetween. The housing is molded onto first and second terminals so that the inward ends are exposed at opposite ends of the floor and the pins extend downward therefrom through the housing. A contact arm is fixed to the inward end of the first terminal and has a cantilever arm whose free end has a contact fixed thereto and is biased away from but movable toward a fixed contact on the inward end of the second terminal. A fulcrum plate having a central dimple is fixed between the sidewalls and a bimetal strip is located between the fulcrum plate and the contact arm. The bimetal strip has two stable positions (bistable); in a first stable position the strip is bowed convexly against the dimple and biases the contact on the contact arm against the contact on the second terminal to complete the circuit between the first and second terminals. In the second stable position, which occurs above a predetermined temperature, the bimetal strip is bowed concavely toward the dimple so that the contact arm springs away from the second terminal to open the circuit. The foregoing describes an "open on rise" thermostat; a "close on rise" device can be provided simply by inverting the bimetal strip.

The DIP thermostat is intended for mounting in airflow sufficient to activate the switch conduction from the ambient air. It would also be desirable to provide a board mounted thermostat suitable for sensing the surface temperature of a heat sink or cabinet.

SUMMARY OF THE INVENTION

The board mounted thermostat of the present invention is virtually identical to a TO-220 package as depicted in FIG. 1. This package has but two pin terminals and further has a mounting bracket fixed thereto. The terminals are flat stamped pieces to which the housing is molded. The operational components are as described in the prior art patent, but includes a cover plate incorporating the mounting bracket fixed over the cavity, which provides means for heat transfer to the thermostat to assure timely operation and thus protect the system. Thus, while a standard TO-220 electronic package uses the mounting bracket to conduct heat away from a semiconductor chip, the thermostat of the present invention uses the bracket to conduct heat from a nearby surface to the thermostat.

DETAILED DESCRIPTION OF THE PREFERRED EMBODIMENT

Figure 1:
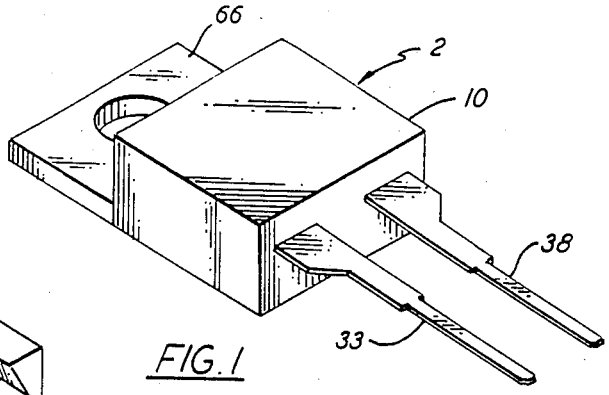
FIG. 1 is a perspective of a TO-220 package.
Figure 2:
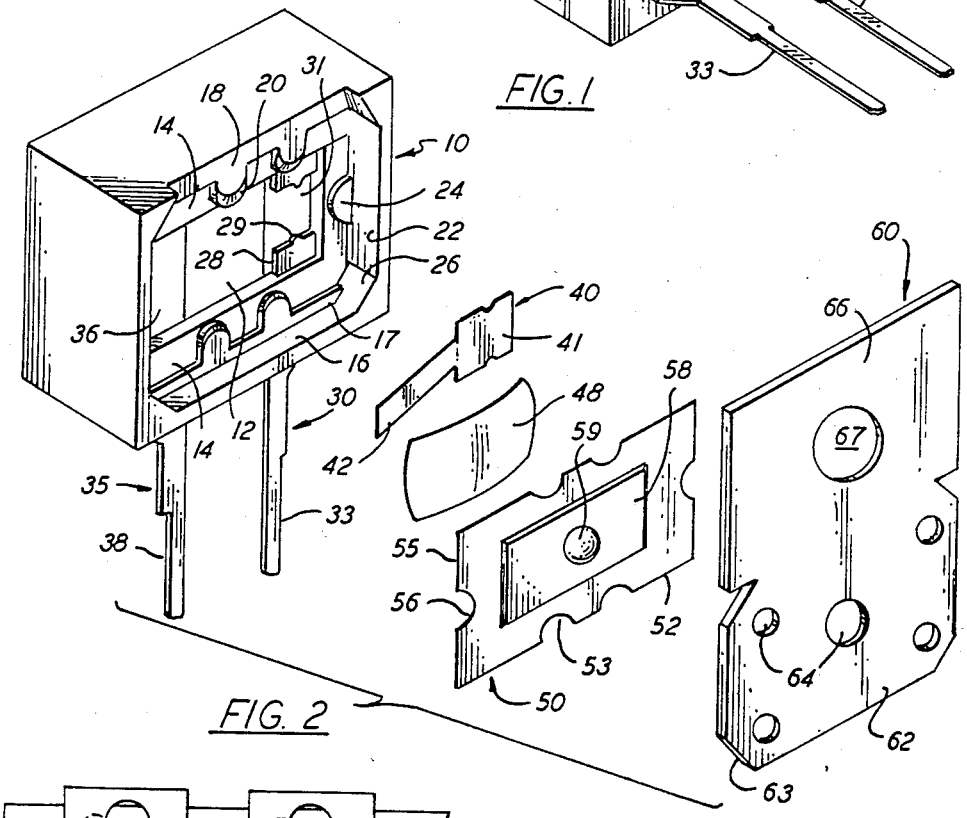
FIG. 2 is an exploded perspective of the thermostat.

FIG. 1 dpicts a standard TO-220 electronic package 2, which includes a dielectric housing 10, pin terminals 33 and 38, and a mounting bracket 66. The single pole, single throw snap action thermostat of the present invention occupies the identical package, and is shown exploded in FIG. 2. The dielectric housing 10 is molded onto terminals 30, 35 in a straight draw to form a box-like structure having a cavity bounded by floor 12, sidewalls 16, and endwalls 22. The preferred material is a high temperature plastic such as Ryton R-10. The terminals 30, 35 have respective inner portions 31, 36 which are inset in floor 12 so as to be flush therewith. The floor 12 is surrounded by a peripheral platform 14 from which locating portions 28 having ribs 29 extend over the inner portion 31. Sidewalls 14 have two pairs of opposing tongues 18 extending toward each other while endwalls 22 have one pair of opposed tongues 24. All tongues stand proud of platform 14 and have stepped ends 20 whose function will be described.

Referring still to FIG. 22, the contact arm 40 is stamped and formed from spring metal with a first end or base 41 which is notched for reception between ribs 29 and a second or free end 42. During assembly the first end 41 is resistance welded to inner portion 31 so that second end 42 is biased away from inner portion 36. Bimetal strip 48 is a conventional dished element which flips at a predetermined temperature, typically from 40° to 150° C. During assembly the strip 48 is placed in the cavity against arm 40 so that it is free and unrestrained on all sides. The fulcrum plate 50 is then placed against platform 14 to capture the element 48. The fulcrum plate is stamped from aluminum with side edges 52 having scallops 53 for reception about tongues 18, and end edge 55 having scallops 56 for reception about tongues 24. The plate 50 is also formed with a raised portion 58 having dimple 59 which extends into the cavity. After emplacing the arm 40, and element 48, fulcrum plate 50 is retained against platform 14 by heat staking the tongues 18, 24. This is accomplished by applying heat and pressure to the stepped portions 20; the steps 20 ensure that any displaced plastic will not extend above the highest profile of the tongues. An epoxy is then applied to the top of the fulcrum plate 50 and the mounting plate 60 is emplaced, whereafter the assembly is baked to cure the epoxy. The plate 60 is a nickel plated copper piece having a cover portion 62 with beveled corners 63 profiled to fit against beveled corners 26 in the housing 10. Holes 64 take up excess epoxy. The plate 60 also includes a bracket 66 having a central hole 67 for receiving screw means.

Figure 3:
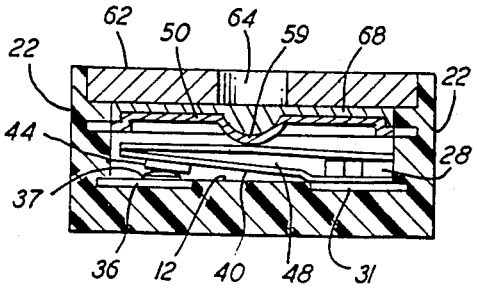
FIG. 3 is a section view of the assembled thermostat.

FIG. 3 shows the cooperation of the parts in greater detail. The inner portion 36 of second terminal 35 has a gold plated contact 37 fixed thereto by resistance welding, while the free end of contact arm 40 has a contact 44 fixed thereto. The bimetallic element 48 is shown bowed convexly toward the dimple or fulcrum point 59 so that circuit between terminals 30, 35 is closed. When the characteristic temperature is reached, the element "snaps" to an oppositely bowed configuration so that the circuit opens. A "close on rise" device can be provided simply by inverting the bimetallic strip. The epoxy 68, in addition to providing a sealing and retaining function, reinforces the dimple 59 so that proper calibration is maintained and further assures good heat transfer between the fulcrum plate 50 and mounting plate 60.

Figure 4:
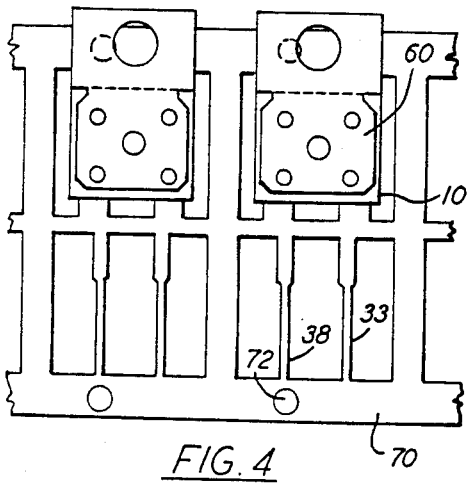
FIG. 4 is a plan view of the thermostat in strip form.

Referring particularly to FIG. 4, the manufacture of the inventive switch can be understood. The terminal pins 33, 38 are part of a stamped metal strip bounded by carrier strips 70 having indexing holes 72 which facilitate indexing through the various work stations. The strip is first fed through a molding station where the housing is molded thereon, then proceeds through various stations where the parts are assembled as previously described to yield the assembly shown. The individual thermostats are then sheared from the carriers and packaged in tubes or the like for use by the customer.

The foregoing is exemplary and not intended to limit the scope of the claims which follow.

What is claimed:

1. A thermostatic switch for mounting to a circuit board, comprising:

a molded dielectric housing of boxlike shape having a cavity bounded by a floor, opposed parallel endwalls, and opposed parallel sidewalls, first and second terminals having inner parts disposed inside said housing in said floor toward respective endwalls, the inner part of said second terminal having a fixed contact thereon, each said terminal having an external mounting pin, said inner parts connecting to said pins through one of said sidewalls, an elongate contact arm having a first end fixed to the inner part of said first terminal and an opposed second end biased away from the inner part of said second terminal but movable theretoward, said second end having a movable contact fixed thereto, a stamped metal fulcrum plate between said sidewalls and said endwalls in said cavity, said plate having a substantially central dimple extending toward said floor, said dimple serving as a fulcrum point, an elongate bistable bimetallic element arranged between said fulcrum plate and said contact arm so that in one stable position the movable contact is against said fixed contact and in the other stable position the movable contact is displaced from said fixed contact, a metal mounting plate covering said cavity opposite said floor, said plate having a mounting bracket extending beyond the sidewall opposite said one sidewall through which said pins extend and a layer of epoxy between said fulcrum plate and said cover plate, said epoxy reinforcing said fulcrum plate and retaining said cover plate to said housing

2. A thermostatic switch as in claim 1 further comprising a platform above said floor about the periphery thereof, said platform supporting said fulcrum plate about its periphery.

3. A thermostatic switch as in claim 2 wherein said housing comprises a pair of opposed first tongues extending toward each other from opposite side walls, said tongues standing proud of said platform, said fulcrum plate having opposed side edges which are scalloped to receive said tongues.

4. A thermostatic switch as in claim 3 wherein said tongues are stepped toward said platform at their respective inward ends.

5. A thermostatic switch as in claim 2 wherein said housing further comprises a pair of opposed second tongues extending toward each other from opposite end walls, said tongues standing proud of said platform, said fulcrum plate having opposed end edges which are scalloped to receive said tongues.

6. A thermostatic switch as in claim 1 wherein said housing is molded onto said terminals.

* * * * *